US005734956A

United States Patent [19]

Matalevich

[11] Patent Number: 5,734,956

[45] Date of Patent: Mar. 31, 1998

[54] DEVELOPMENT SYSTEM USING AN AC RECTIFIED WAVEFORM

[75] Inventor: Joseph R. Matalevich, Webster, N.Y.

[73] Assignee: Xerox Corporation, Stamford, Conn.

[21] Appl. No.: 785,678

[22] Filed: Jan. 21, 1997

[51] Int. Cl.[6] ..... G03G 15/08

[52] U.S. Cl. ..... 399/291

[58] Field of Search ..... 399/222, 252, 399/290, 291, 285

[56] References Cited

U.S. PATENT DOCUMENTS 5,172,170 12/1992 Hays et al. ..... 399/285 X 5,206,693 4/1993 Folkins ..... 399/291

*Primary Examiner*—S. Lee

*Attorney, Agent, or Firm*—Lloyd F. Bean

[57] ABSTRACT

An apparatus for developing a latent image recorded on a surface, including a housing defining a chamber storing a supply of developer material including toner; a toner donor member spaced from the surface and being adapted to transport toner to a region opposed from the surface, the donor member having an electrode member associated therewith; developer material is conveyed in the chamber of the housing onto the donor member; a first AC source for AC biasing the electrode member; and a second AC source for AC biasing the electrode member with an AC rectified waveform, said first and second AC source coacting to detach toner from said donor member as to form a toner cloud for developing the latent image.

10 Claims, 4 Drawing Sheets

DEVELOPMENT SYSTEM USING AN AC RECTIFIED WAVEFORM

BACKGROUND OF THE INVENTION

This invention relates generally to a development apparatus for ionographic or electrophotographic imaging and printing apparatuses and machines, and more particularly is directed to an interdigitated electroded donor roll with charged toner particles. An AC voltage having a rectified waveform which is applied to closely spaced interdigitated electrodes to form a toner cloud in the development zone for the development of a latent electrostatic image.

Generally, the process of electrophotographic printing includes charging a photoconductive member to a substantially uniform potential so as to sensitize the surface thereof. The charged portion of the photoconductive surface is exposed to a light image from either a scanning laser bean or an original document being reproduced. This records an electrostatic latent image on the photoconductive surface. After the electrostatic latent image is recorded on the photoconductive surface, the latent image is developed. Two component and single component developer materials are commonly used for development. A typical two component developer comprises magnetic carrier granules having toner particles adhering triboelectrically thereto. A single component developer material typically comprises toner particles. Toner particles are attracted to the latent image forming a toner powder image on the photoconductive surface, the toner powder image is subsequently transferred to a copy sheet, and finally, the toner powder image is heated to permanently fuse it to the copy sheet in image configuration.

The electrophotographic marking process given above can be modified to produce color images. One color electrophotographic marking process, called image on image processing, superimposes toner powder images of different color toners onto the photoreceptor prior to the transfer of the composite toner powder image onto the substrate. While image on image process is beneficial, it has several problems. For example, when recharging the photoreceptor in preparation for creating another color toner powder image it is important to level the voltages between the previously toned and the untoned areas of the photoreceptor.

Moreover, the viability of printing system concepts such as image on image processing usually requires development systems that do not scavenge or interact with a previously toned image. Since several known development systems, such as conventional magnetic brush development and jumping single component development, interact with the image receiver, a previously toned image will be scavenged by subsequent development, and as these development systems are highly interactive with the image bearing member, there is a need for scavengeless or noninteractive development systems.

For scavengeless development systems, a donor roll can be used for transporting charged toner to the development nip defined by the space between the donor roll and photoconductive member. The donor roll can be loaded with toner from either a two component or single component development system. Toner is developed on the latent image recorded on the photoconductive member by a combination of mechanical and/or electrical forces to form a toner cloud in close proximity to the latent electrostatic image. Scavengeless development and jumping development are two types of single component development systems that can be selected. In one version of a scavengeless development system, a plurality of electrode wires are closely spaced from the toned donor roll in the development zone. An AC voltage is applied to the wires to generate a toner cloud in the development zone. The electrostatic fields associated with the latent image attract toner from the toner cloud to develop the latent image. In another version of scavengeless development, interdigitated electrodes are provided within the surface of a donor roll. The application of an AC bias between the adjacent electrodes in the development zone causes the generation of a toner cloud. In another version of a scavengeless development system with a single component loaded donor roll, the toned donor roll is brought into sufficiently close proximity to the electrostatic image such that the DC electric field causes the toner to jump across the gap to the photoreceptor so that the electrostatic fields associated with the latent image attract the toner to develop the latent image.

A problem with scavengeless development systems is not being able to achieve premium fine line and dot print quality while simultaneously maintaining a non-scavenging condition. Under certain system setpoints excellent fine line and dot print quality is achieved, but these tend to be the setpoints that lead to scavenging. Under other system setpoints scavenging is eliminated, but fine line and dot print quality is diminished. The ideal condition is to achieve a high level of print quality while not scavenging,

SUMMARY OF THE INVENTION

Briefly, the present invention obviates the problems noted above by utilizing an apparatus for developing image on image processing, in which toner powder images of different color toners are superimposed onto the photoreceptor prior to the transfer of the composite toner powder image onto the substrate. An apparatus for developing a latent image recorded on a surface, including a housing defining a chamber storing a supply of developer material comprising toner; a toner donor member spaced from the surface and being adapted to transport toner to a region opposed from the surface, said doner member having an electrode member associated therewith; means for conveying said developer material in the chamber of said housing onto said donor member; a first AC source for AC biasing said electrode member; and a second AC source for AC biasing said electrode member with an AC rectified waveform, said first and second AC source coacting to detach toner from said donor member as to form a toner cloud for developing the latent image.

Inasmuch as the art of electrophotographic printing is well known, the various processing stations employed in the printing machine illustrated in FIG. 1 will be shown hereinafter schematically and their operation described briefly with reference thereto.

Figure 1:
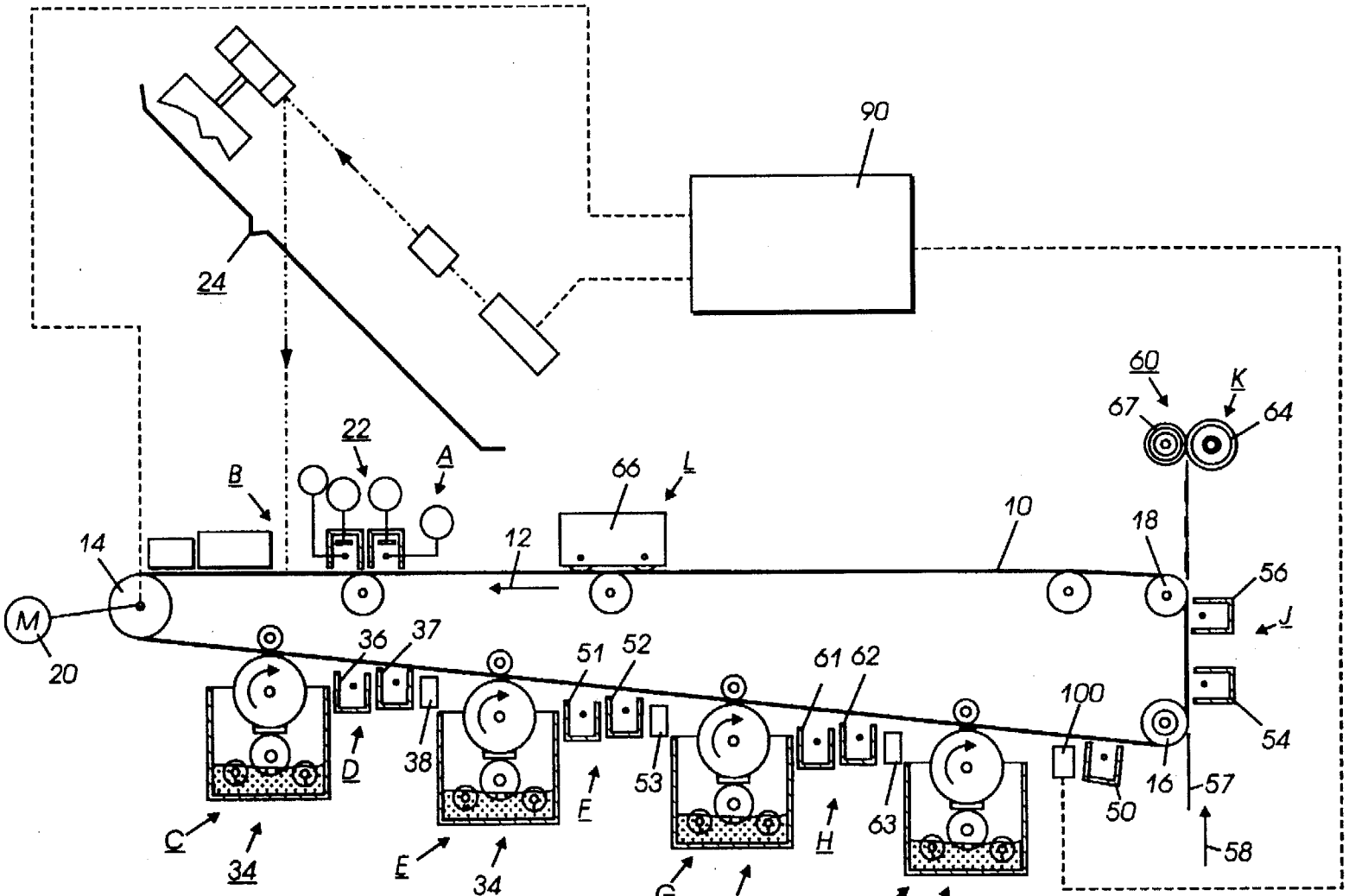
FIG. 1 is a schematic elevational view of an illustrative electrophotographic printing or imaging machine or apparatus incorporating a development apparatus having the features of the present invention therein.

Referring initially to FIG. 1, there is shown an illustrative electrophotographic machine having incorporated therein the development apparatus of the present invention. An electrophotographic printing machine 8 creates a color image in a single pass through the machine and incorporates the features of the present invention. The printing machine 8 uses a charge retentive surface in the form of an Active Matrix (AMAT) photoreceptor belt 10 which travels sequentially through various process stations in the direction indicated by the arrow 12. Belt travel is brought about by mounting the belt about a drive roller 14 and two tension rollers 16 and 18 and then rotating the drive roller 14 via a drive motor 20.

As the photoreceptor belt moves, each part of it passes through each of the subsequently described process stations. For convenience, a single section of the photoreceptor belt, referred to as the image area, is identified. The image area is that part of the photoreceptor belt which is to receive the toner powder images which, after being transferred to a substrate, produce the final image. While the photoreceptor belt may have numerous image areas, since each image area is processed in the same way, a description of the typical processing of one image area suffices to fully explain the operation of the printing machine.

Figure 2A:
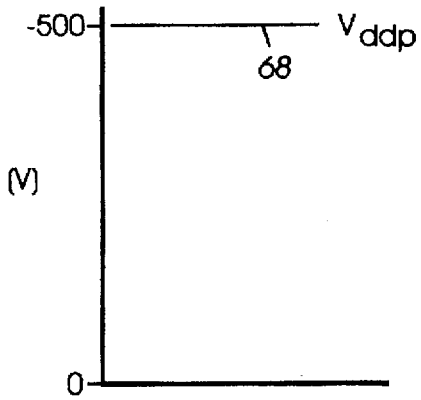
FIG. 2A shows a typical voltage profile of an image area in the electrophotographic printing machines illustrated in FIG. 1 after that image area has been charged.

As the photoreceptor belt 10 moves, the image area passes through a charging station A. At charging station A, a corona generating device, indicated generally by the reference numeral 22, charges the image area to a relatively high and substantially uniform potential. FIG. 2A illustrates a typical voltage profile 68 of an image area after that image area has left the charging station A. As shown, the image area has a uniform potential of about −500 volts. In practice, this is accomplished by charging the image area slightly more negative than −500 volts so that any resulting dark decay reduces the voltage to the desired −500 volts. While FIG. 2A shows the image area as being negatively charged, it could be positively charged if the charge levels and polarities of the toners, recharging devices, photoreceptor, and other relevant regions or devices are appropriately changed.

Figure 2B:
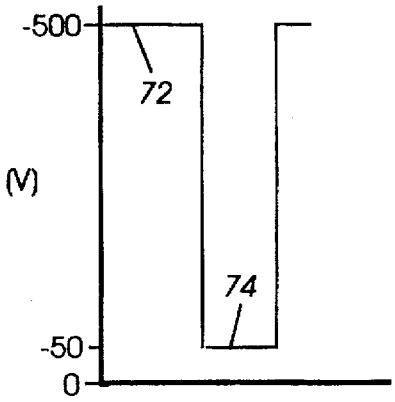
FIG. 2B shows a typical voltage profile of the image area after being exposed.

After passing through the charging station A, the now charged image area passes through a first exposure station B. At exposure station B, the charged image area is exposed to light which illuminates the image area with a light representation of a first color (say black) image. That light representation discharges some parts of the image area so as to create an electrostatic latent image. While the illustrated embodiment uses a laser based output scanning device 24 as a light source, it is to be understood that other light sources, for example an LED printbar, can also be used with the principles of the present invention. FIG. 2B shows typical voltage levels, the levels 72 and 74, which might exist on the image area after exposure. The voltage level 72, about −500 volts, exists on those parts of the image area which were not illuminated, while the voltage level 74, about −50 volts, exists on those parts which were illuminated. Thus after exposure, the image area has a voltage profile comprised of relative high and low voltages.

After passing through the first exposure station B, the now exposed image area passes through a first development station C which is identical in structure with development system E, G, and I. The first development station C deposits a first color, say black, of negatively charged toner 31 onto the image area. That toner is attracted to the less negative sections of the image area and repelled by the more negative sections. The result is a first toner powder image on the image area.

Figure 3:
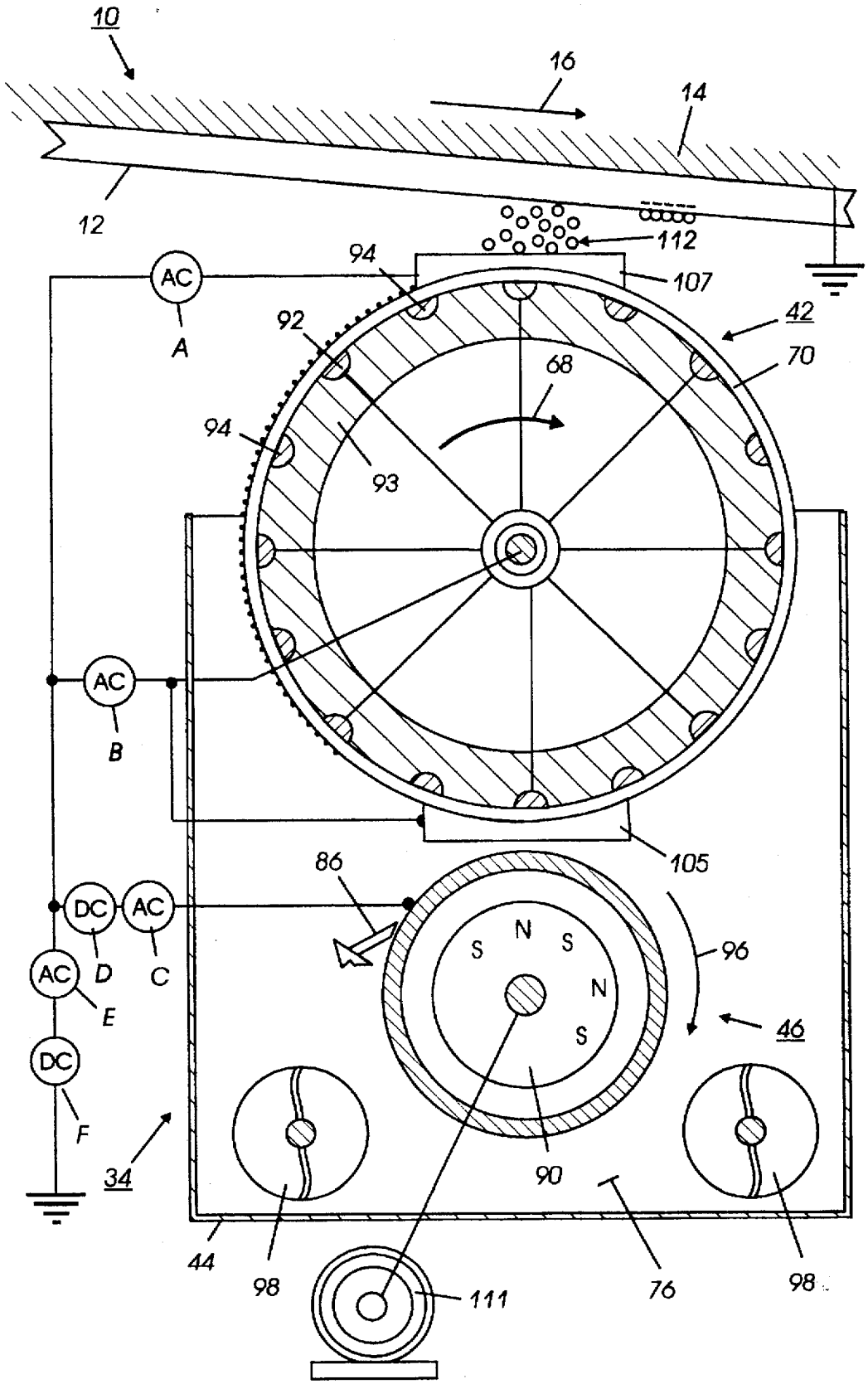
FIG. 3 is a schematic elevational view showing the development apparatus used in the FIG. 1 printing machine.

For the first development station C, development system 34 includes a donor roll 42, and interdigitated electrodes near the surface of the roll. As illustrated in FIG. 3, electrodes 94 are electrically biased with an AC voltage relative to adjacent interdigitated electrodes 92 for the purpose of detaching toner therefrom so as to form a toner powder cloud 112 in the gap between the donor roll and photoconductive surface. Both electrodes 92 and 94 are biased at a DC potential 108 for discharge area development (DAD). The discharged photoreceptor image attracts toner particles from the toner powder cloud to form a toner powder image thereon.

Figure 2C:
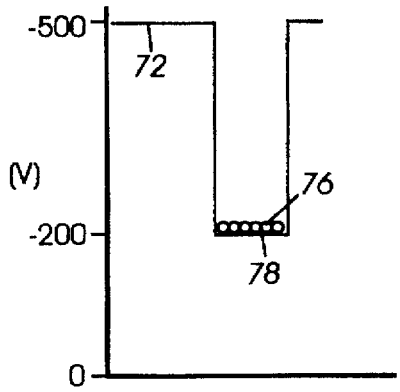
FIG. 2C shows a typical voltage profile of the image area after being developed.

FIG. 2C shows the voltages on the image area after the image area passes through the first development station C. Toner 76 (which generally represents any color of toner) adheres to the illuminated image area. This causes the voltage in the illuminated area to increase to, for example, about −200 volts, as represented by the solid line 78. The unilluminated parts of the image area remain at about the level 72.

From FIG. 1, after passing through the first development station C, the now exposed and toned image area passes to a first recharging station D. The recharging station D is comprised of two corona recharging devices, a first recharging device 36 and a second recharging device 37, which act together to recharge the voltage levels of both the toned and untoned parts of the image area to a substantially uniform level. It is to be understood that power supplies are coupled to the first and second recharging devices 36 and 37, and to any grid or other voltage control surface associated therewith, as required so that the necessary electrical inputs are available for the recharging devices to accomplish their task.

Figure 2D:
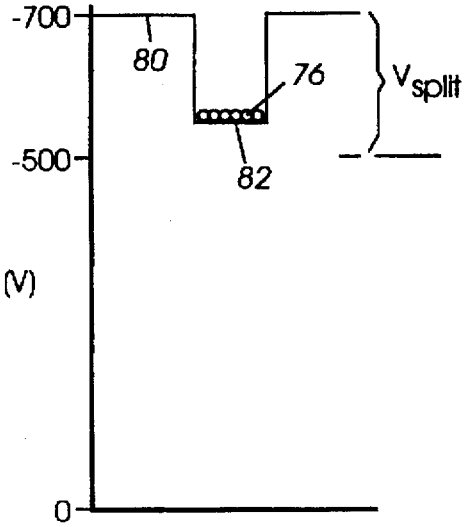
FIG. 2D shows a typical voltage profile of the image area after being recharged by a first recharging device.

FIG. 2D shows the voltages on the image area after it passes through the first recharging device 36. The first recharging device overcharges the image area to more negative levels than that which the image area is to have when it leaves the recharging station D. For example, as shown in FIG. 2D the toned and the untoned parts of the image area, reach a voltage level 80 of about −700 volts. The first recharging device 36 is preferably a DC scorotron.

Figure 2E:
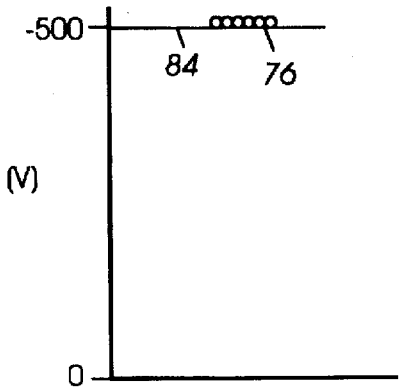
FIG. 2E shows a typical voltage profile of the image area after being recharged by a second recharging device.

After being recharged by the first recharging device 36, the image area passes to the second recharging device 37. Referring now to FIG. 2E, the second recharging device 37 reduces the voltage of the image area, both the untoned parts and the toned parts (represented by toner 76) to a level 84 which is the desired potential of −500 volts.

Figure 2F:
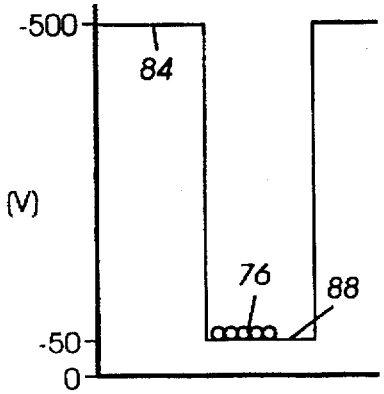
FIG. 2F shows a typical voltage profile of the image area after being exposed for a second time.

After being recharged at the first recharging station D, the now substantially uniformly charged image area with its first toner powder image passes to a second exposure station 38. Except for the fact that the second exposure station illuminates the image area with a light representation of a second color image (say yellow) to create a second electrostatic latent image, the second exposure station 38 is the same as the first exposure station B. FIG. 2F illustrates the potentials on the image area after it passes through the second exposure station. As shown, the non-illuminated areas have a potential about −500 as denoted by the level 84. However, illuminated areas, both the previously toned areas denoted by the toner 76 and the untoned areas are discharged to about −50 volts as denoted by the level 88.

The image area then passes to a second development station E, as shown in FIG. 1. Except for the fact that the second development station E contains a toner which is of a different color (yellow) than the toner (black) in the first development station C, the second development station is beneficially the same as the first development station. Since the toner is attracted to the less negative parts of the image area and repelled by the more negative parts, after passing through the second development station E the image area has first and second toner powder images which may overlap.

The image area then passes to a second recharging station F. The second recharging station F has first and second recharging devices, the devices 51 and 52, respectively, which operate similar to the recharging devices 36 and 37. Briefly, the first corona recharge device 51 overcharges the image areas to a greater absolute potential than that ultimately desired (say −700 volts) and the second corona recharging device, comprised of coronodes having AC potentials, neutralizes that potential to that ultimately desired.

The now recharged image area then passes through a third exposure station 53. Except for the fact that the third exposure station illuminates the image area with a light representation of a third color image (say magenta) so as to create a third electrostatic latent image, the third exposure station 38 is the same as the first and second exposure stations B and 38. The third electrostatic latent image is then developed using a third color of toner (magenta) contained in a third development station G.

The now recharged image area then passes through a third recharging station H. The third recharging station includes a pair of corona recharge devices 61 and 62 which adjust the voltage level of both the toned and untoned parts of the image area to a substantially uniform level in a manner similar to the corona recharging devices 36 and 37 and recharging devices 51 and 52.

After passing through the third recharging station the now recharged image area then passes through a fourth exposure station 63. Except for the fact that the fourth exposure station illuminates the image area with a light representation of a fourth color image (say cyan) so as to create a fourth electrostatic latent image, the fourth exposure station 63 is the same as the first, second, and third exposure stations, the exposure stations B, 38, and 53, respectively. The fourth electrostatic latent image is then developed using a fourth color toner (cyan) contained in a fourth development station I.

To condition the toner for effective transfer to a substrate, the image area then passes to a pretransfer corotron member 50 which delivers corona charge to ensure that the toner particles are of the required charge level so as to ensure proper subsequent transfer.

After passing the corotron member 50, the four toner powder images are transferred from the image area onto a support sheet 52 at transfer station J. It is to be understood that the support sheet is advanced to the transfer station in the direction 58 by a conventional sheet feeding apparatus which is not shown. The transfer station J includes a transfer corona device 54 which sprays positive ions onto the backside of sheet 52. This causes the negatively charged toner powder images to move onto the support sheet 52. The transfer station J also includes a detack corona device 56 which facilitates the removal of the support sheet 52 from the printing machine 8.

After transfer, the support sheet 52 moves onto a conveyor (not shown) which advances that sheet to a fusing station K. The fusing station K includes a fuser assembly, indicated generally by the reference numeral 60, which permanently affixes the transferred powder image to the support sheet 52. Preferably, the fuser assembly 60 includes a heated fuser roller 62 and a backup or pressure roller 64. When the support sheet 52 passes between the fuser roller 62 and the backup roller 64 the toner powder is permanently affixed to the sheet support 52. After fusing, a chute, not shown, guides the support sheets 52 to a catch tray, also not shown, for removal by an operator.

After the support sheet 52 has separated from the photoreceptor belt 10, residual toner particles on the image area are removed at cleaning station L via a cleaning brush contained in a housing 66. The image area is then ready to begin a new marking cycle.

The various machine functions described above are generally managed and regulated by a controller which provides electrical command signals for controlling the operations described above.

Referring now to FIG. 3 in greater detail, development system 34 includes a housing 44 defining a chamber 76 for storing a supply of developer material therein. Donor roll 42 comprises first and second sets of electrodes 92 and 94. The active interdigitated electrodes 94 and passive interdigitated electrodes 92 are near a transfer roll 310 of housing 44. The donor roll can be rotated in either the "with" or "against" direction relative to the direction of motion of the belt 10. Similarly, the transfer roll can be rotated in either the "with" or "against" direction relative to the direction of motion of the donor roll 42. In FIG. 3, donor roll 42 is shown rotating in the direction of arrow 68, that is the "with" direction. The core 93 of the donor roll is preferably comprised of a dielectric base, such as a polymeric material like a vinyl ester. The interdigitated electrodes near the surface of the donor roll are overcoated with a charge relaxable material 70.

Primary AC power sources A and B applies an electrical bias of, for example, 450 volts peaks at 3 kHz employing a sine wave waveshape, between one set of electrodes 92 and the other set of electrodes 94. AC power source A is 180 degrees out of phase with AC power source B. The electrodes 94 extend to one end of the donor roll to contact the commutator brush 107 which is attached to the AC power source A. AC power source (C) is used to improve the performance of loading toner on the donor roll. It has typical values of: amplitude: 350 volts peak, waveshape being a sine wave 400, frequency: 3000 Hz, and AC power source (C) is in phase with AC power source (B).

The electrodes 92 are all connected together at the opposite end of the donor roll and attached to the DC supply F as well as the transfer roll-donor roll commutator brush 105. A DC bias from 0 to 1,000 volts is applied by a DC power source F to all of the electrodes of both sets of electrodes 92 and 94. An AC bias is applied by an AC power source E to all of the electrodes of both sets of electrodes 92 and 94.

Figure 4:
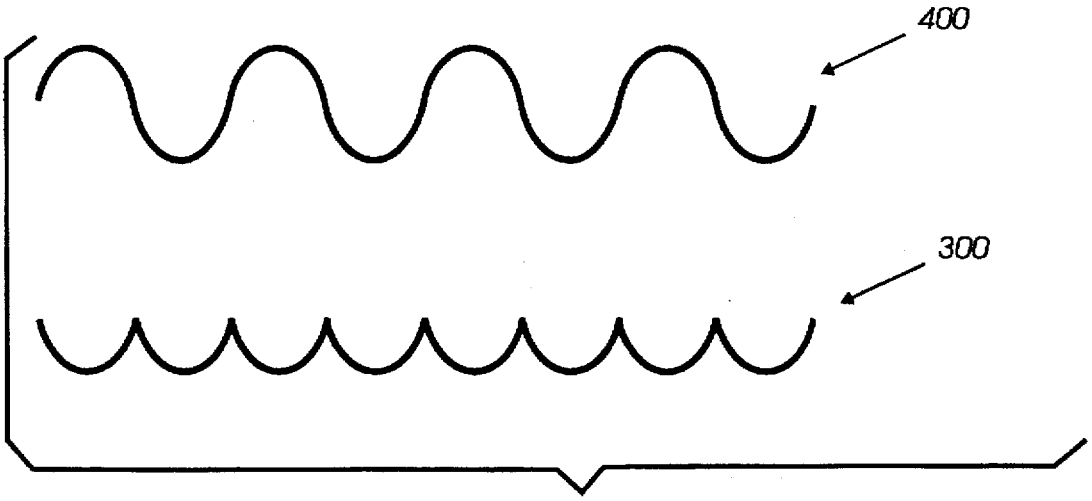
FIG. 4 shows a AC rectified waveform employed with the present invention and a sine wave.

The rectified waveform 300 (as shown in FIG. 4) is supplied by AC power source (E). This AC is supplied to all the elements in the development system (i.e. the mag roll and both sets of electrodes). This means that there are no electric fields created internal to the developer housing due to this AC. The fields are created between the photoreceptor (which is at ground) and both sets of electrodes. There is no necessary frequency or phase relationship between the rectified waveform from AC power source (E) and the primary AC power source (A&B). AC power source (E) has the following typical values: waveshape: rectified sine wave, amplitude: 100 to 500 volts peak, and frequency: 200 to 3000 Hz.

The AC voltage applied by AC power sources A, B, and E, between the set of interdigitated electrodes establishes AC fringe fields serving to liberate toner particles from the surface of the donor structure 42 to form the toner cloud 112 in the development zone 300. The AC voltage is referenced to the DC and AC bias applied to the electrodes so that the time average of the AC bias is equal to the AC bias applied. Thus, the equal DC bias on adjacent electrodes precludes the creation of DC electrostatic fields between adjacent electrodes which would impede toner liberation by the AC fields the development zone 300.

When the AC fringe field is applied to a toner layer via an electrode structure in close proximity to the toner layer, the time-dependent electrostatic force acting on the charged toner momentarily breaks the adhesive bond to cause toner detachment and the formation of a powder cloud or aerosol layer 112. The DC electric field from the electrostatic image and the secondary AC field created by AC power source E controls the deposition of toner on the image receiver.

The two sets of electrodes 92 and 94 are supported on a dielectric cylinder 93 and oriented in the axial direction near the surface in a circular orientation. A thin charge relaxable coating 70 is applied over the electrodes to prevent air breakdown between the AC biased interdigitated electrodes. Each of the electrodes 94 are electrically isolated on the donor roll whereas all of the electrodes 92 are connected.

Applicant have found that the waveforms (specifically sine waves; 100–300 Volts peak; 1000–3000 Hz) when implemented in AC power source (E) were found to yield improved fine line and dot print quality over the case where no AC power source (E) was used. (AC power sources A and B were implemented in both cases). Unfortunately, this improved fine line and dot print quality is accompanied by an increase in toner scavenging. It is believed the theory behind this behavior is that this additional AC field controls the movement of the toner powder cloud in the development nip. The field has the effect of imparting energy to the cloud and effectively moving it closer to the photoreceptor. While this improves print quality it also causes the cloud to disrupt (scavenge) previously developed images.

It has been found that the rectified waveform can improved print quality which can be achieved without adding the detriment of toner scavenging. A non-rectified sine wave is symmetric; the rectified waveform is not. Therefore, the rectified waveform applies non-symmetric forces to the toner powder cloud in the nip. This has the effect of moving the cloud close to the image to improve fine line and dot print quality; but does not pull the cloud away from the nip in the same manner (if it did; this would result in toner scavenging).

Referring back to FIG. 3, charged toner particles are conveyed to a loading zone using a magnetic brush device 46 which comprises a stationary magnet assembly 90 and a rotatable sleeve. The stationary magnet assembly comprises a plurality of alternately polarized pole pieces. A two component developer comprising carrier beads and toner particles is contained in a supply sump 96 from which it is conveyed by the sleeve to the loading zone.

As successive electrostatic latent images are developed, the toner particles within the chamber 76 are depleted to an undesirable level. A toner dispenser (not shown) stores a supply of toner particles. The toner dispenser is in communication with chamber 76 of housing 34. As the level of toner particles in the chamber is decreased, fresh toner particles are furnished from the toner dispenser. In this manner, a substantially constant amount of toner particles are in the chamber of the developer housing with the toner particles.

Other embodiments and modifications of the present invention may occur to those skilled in the art subsequent to a review of the information presented herein; these embodiments and modifications, as well as equivalents thereof, are also included within the scope of this invention.

I claim:

1. An apparatus for developing a latent image recorded on a surface, comprising:

a housing defining a chamber storing a supply of developer material comprising toner;

a toner donor member, spaced from the surface, for transporting toner to a region opposed from the surface, said donor member having an electrode member associated therewith;

means for conveying said developer material in the chamber of said housing onto said donor member;

a first AC source for AC biasing said electrode member; and a second AC source for AC biasing said electrode member with an AC rectified waveform, said first and second AC source coacting to detach toner from said donor member as to form a toner cloud for developing the latent image.

2. The apparatus of claim 1, wherein said second AC source has a voltage between 100 to 500 volts.

3. The apparatus of claim 1, wherein said second AC source has a frequency between 200 and 3000 Hz.

4. The apparatus of claim 1, wherein said second AC source employs a rectified sine wave.

5. The apparatus of claim 1, wherein said first AC source employs a sine wave.

6. An electrophotographic printing machine, wherein an electrostatic latent image recorded on a surface of photoconductive member is developed to form a visible image thereof, comprising:

a housing defining a chamber storing a supply of developer material comprising toner;

a toner donor member, spaced from the surface, for transporting toner to a region opposed from the surface, said donor member having an electrode member associated therewith;

means for conveying said developer material in the chamber of said housing onto said donor member;

a first AC source for AC biasing said electrode member; and a second AC source for AC biasing said electrode member with an AC rectified waveform, said first and second AC source coacting to detach toner from said donor member as to form a toner cloud for developing the latent image.

7. The electrophotographic printing machine of claim 6, wherein said second AC source has a voltage between 100 to 500 volts.

8. The electrophotographic printing machine of claim 6, wherein said second AC source has a frequency between 200 and 3000 Hz.

9. The electrophotographic printing machine of claim 6, wherein said second AC source employs a rectified sine wave.

10. The electrophotographic printing machine of claim 6, wherein said first AC source employs a sine wave.

* * * * *